United States Patent [19]

Palmer

[11] 4,109,195

[45] Aug. 22, 1978

[54] DIGITAL DWELL-TACHOMETER WITH POINTS RESISTANCE INDICATION CAPABILITY

[76] Inventor: Harold R. Palmer, 10704 Blossom La., Silver Spring, Md. 20903

[21] Appl. No.: 794,843

[22] Filed: May 9, 1977

[51] Int. Cl.[2] ..... F02P 17/00

[52] U.S. Cl. ..... 324/15; 324/28 CR

[58] Field of Search ..... 324/16 R, 15, 28 CR

[56] References Cited

U.S. PATENT DOCUMENTS

| | | | |
|---|---|---|---|
| 2,335,248 | 11/1943 | Hanson | 324/15 |
| 3,158,804 | 11/1964 | Weissert | 324/15 |
| 3,886,450 | 5/1975 | Trussell et al. | 324/16 R X |
| 3,961,239 | 6/1976 | Lach | 324/15 |
| 3,986,009 | 10/1976 | Fastaia | 324/16 R X |

*Primary Examiner*—Stanley T. Krawczewicz

[57] ABSTRACT

The present invention is a device to measure and display digitally the automotive engine parameters RPM (rotations per minute), dwell, and points resistance. The general approach taken is to establish a signal with a current controlled oscillator whose frequency is proportional to the above engine parameters. This signal is then processed by a digital counter whose count interval characteristics are determined by the number of cylinders in the automobile engine. The contents of the counter are converted to a digital format and displayed as an accurate representation of the parameters to be measured.

6 Claims, 6 Drawing Figures

DIGITAL DWELL-TACHOMETER WITH POINTS RESISTANCE INDICATION CAPABILITY

BACKGROUND OF THE INVENTION

The present invention pertains generally to automotive dwell-tachometers with points resistance indication capability. Conventional equipment uses an analog measurement readout via a conventional meter face. This type of equipment is difficult to read by an untrained automotive mechanic and is limited in accuracy because of the necessity to interpolate between printed markers on the meter face. To partially alleviate this problem some conventional equipment use switchable meter scales to increase the reading resolution for the mechanic. This however, requires the mechanic to keep track of multiple scales on the meter face and complicates the design and manufacture of such equipment.

Also much conventional equipment is designed such that the dwell measurement accuracy is a function of the physical condition of the ignition points.

Prior digital devices have suffered from several deficiencies namely, no provision for points resistance reading, and RPM readings which do not provide sufficient accuracy for tune up applications on modern automotive engines.

SUMMARY OF THE INVENTION

The present invention overcomes the disadvantages and limitations of the prior art by providing an instrument (digital dwell-tachometer with points resistance indication capability) with digital display capability, without the need to change settings for high and low RPM or interpolate between the markings on a printed meter face and with the capability of more accurately measuring dwell when the ignition points are in poor condition. The instrument appropriately processes the standard ignition system voltage signals so that the measured quantities are converted into a digital format and displayed on a digital display device.

It is therefore an object of the present invention to provide a digital dwell-tachometer with points resistance indication capability which will not have separate high and low RPM switch positions when operated in the RPM mode.

It is also an object of the present invention to provide a digital dwell-tachometer with points resistance indication capability which will have improved measurement accuracy in the dwell mode when operated on an automobile with ignition points which are in poor physical condition.

An additional object of the present invention is to provide a digital dwell-tachometer with points resistance indication capability which will allow an accurate determination of RPM to the nearest whole number.

DETAILED DESCRIPTION OF THE PREFERRED EMBODIMENT

Figure 1:
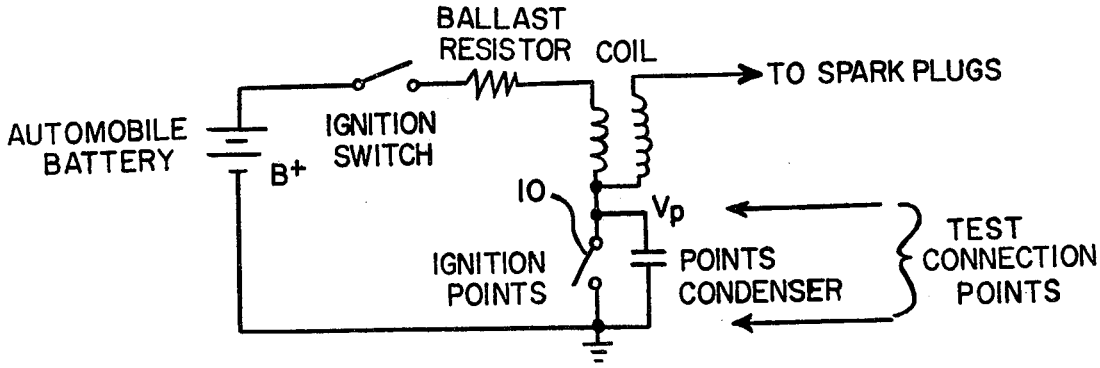
FIG. 1 Common Automotive Ignition System Schematic

The common automotive ignition system schematic is shown in FIG. 1. Although some modern systems do not conform exactly to this schematic, the present invention will still perform properly with those systems. Most existing instruments connect to this circuit as shown. For compatibility reasons this signal point will be used on the present invention. This connection mode is particularly appropriate in light of the fact that this is the only connection for points resistance determination and it would be simpler if only one connection were required for all tests.

Figure 2:
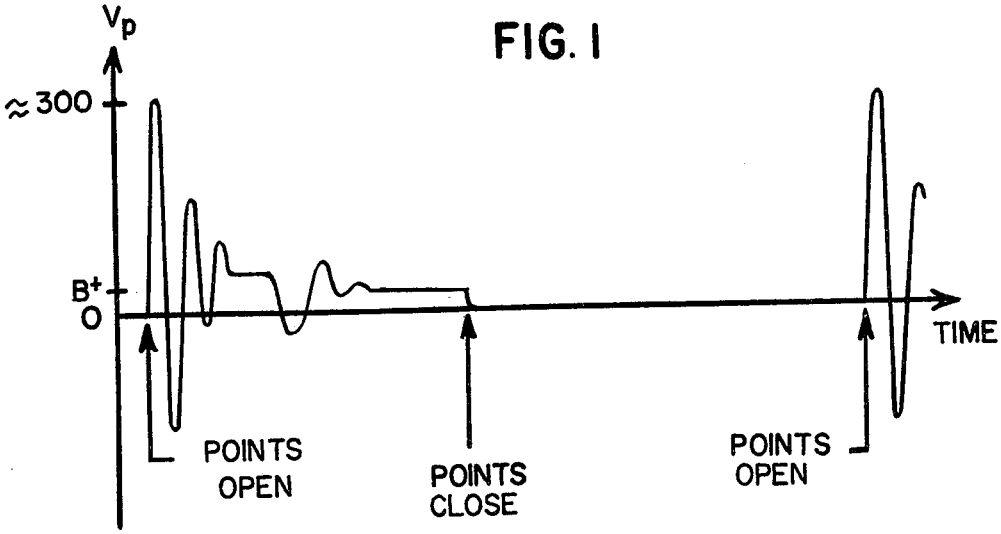
FIG. 2 Ignition Points Voltage Waveform
Figure 3:
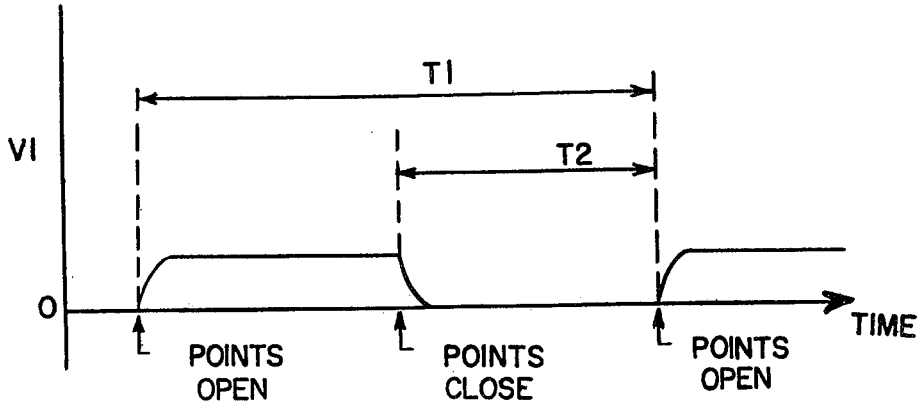
FIG. 3 Filtered Ignition Points Voltage Waveform

The voltage waveform Vp which appears across the ignition points 10 is shown in FIG. 2. Voltage limiting and low pass filtering transforms the waveform in FIG. 2 into that shown in FIG. 3.

Dwell angle is a measure of the number of degrees of distributor camshaft rotation during which the points are closed. Therefore dwell angle can be expressed as:

$$\text{dwell} = \frac{T2}{T1} \; \frac{360}{n} \text{ degrees} \tag{1}$$

where $n$ = number of cylinders in the engine

RPM (rotations per minute) can be expressed in terms of the repetition frequency (f) of the voltage waveform V1. Since a four cycle engine fires only half the cylinders per complete crankshaft revolution:

$$\text{RPM} = \frac{1}{T1}\left(\frac{2}{n}\right)\left(60\,\frac{\text{sec}}{\text{min}}\right) = \frac{120}{n} f \tag{2}$$

$$\text{where } f = \frac{1}{T1}$$

Figure 4:
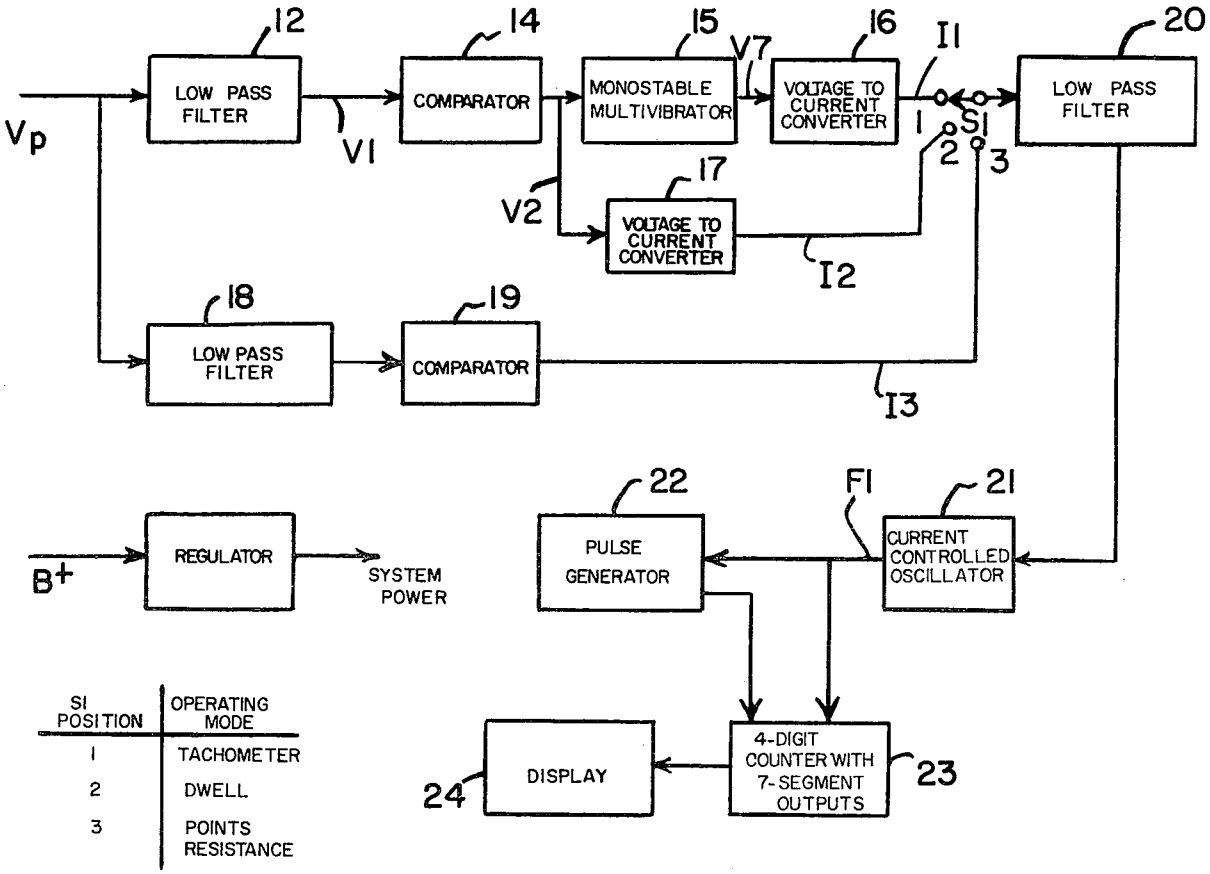
FIG. 4 Block Diagram of the Preferred Embodiment

The block diagram for implementation of these equations and points resistance indication is shown in FIG. 4.

The basic approach for dwell and tachometer operation is to establish a frequency F1 within the current controlled oscillator which is directly proportional to the quantities being measured. The signal F1 is then fed into a 4-digit counter 23 which counts cycles of F1 for a specific length of time determined by the setting of the pulse generator 22. The counting time interval is a function of the number of cylinders and is selected via a manually operated switch within pulse generator 22. The changing count time interval reflects the different values of $n$ in equations (1) and (2). The 4 digit counter 23 has an internal output latch which is activated at the end of the counting interval so that the displayed quantity in the display device 24 represents the number of cycles of F1 counted during the count interval. This counting and latch process is continuously repeated so that the displayed quantity is updated to reflect changing engine conditions. For example: if 500 RPM caused F1 = 1000 cycles/sec. and the count interval were 0.5 sec., then the decade counter 23 would count 500 cycles and this quantity would be displayed as 500 RPM.

Figure 5:
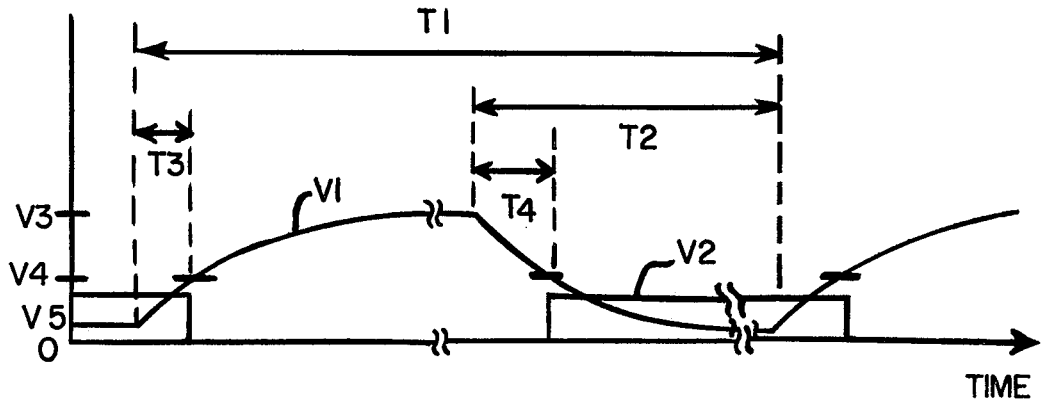
FIG. 5 Comparator 14 Input and Output Voltage Waveforms

System operation in dwell mode can be seen by looking at FIG. 5 which shows V1 (the output of low pass filter 12) and V2 (the output of comparator 14) on the same axis drawn to accentuate the charge and discharge times of low pass filter 12 (low pass filter 12 is a single section filter with time constant $\tau$).

V5 is the voltage which appears across the ignition points 10 when they are in the closed position. V3 is the maximum output voltage when the low pass filter 12 is fully charged. V4 is the threshold voltage of comparator 14. Ideally, V5 = 0 and the value of V4 can be chosen so that T3 = T4. The average value of V2 is then directly proportional to dwell via equation (1). V2 is then converted into a current signal I2 in voltage to current converter 17. I2 is filtered by low pass filter 20, and applied to the current controlled oscillator 21 whose average frequency is therefore proportional to dwell. The decade counter 23 counts cycles of F1 for the appropriate time interval and the dwell angle is displayed as previously described.

In the non ideal case V5 ≠ 0 and $$T3 = -\tau \ln \left( \frac{V3 - V4}{V3 - V5} \right) \quad (3)$$

$$T4 = -\tau \ln \left( \frac{V4 - V5}{V3 - V5} \right) \quad (4)$$

The average value of V2 is then proportional to $$\left( \frac{T2 - T4 + T3}{T1} \right)$$

and the ratio of measured dwell to correct dwell is $$r1 = 1 + \frac{T3 - T4}{T2} \quad (5)$$

Figure 6:
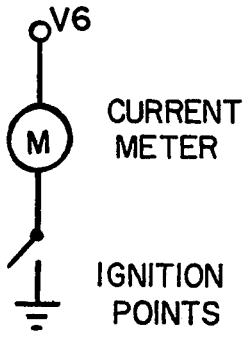
FIG. 6 Conventional Dwell Measurement Technique Simplified Schematic

The simplified schematic of a conventional dwell measurement approach is shown in FIG. 6. The ratio of measured to correct dwell in this case is $$r2 = \frac{V6 - V5}{V6} \quad (6)$$

Practical limitations of circuit implementation are such as to make *r*1 greater than *r*2. Therefore, the present invention has better dwell measurement accuracy. (A comparison between the present invention and a typical conventional design might indicate an improvement in percentage dwell error by as much as five to one.)

In the tachometer mode, the output of comparator 14 is used by monostable multivibrator 15 to derive one constant width pulse for every cycle of V1. The average value of V7 is proportional to the frequency of V7 and RPM through equation (2). The pulses of V7 are converted to current pulses I1 in voltage to frequency converter 16, filtered in low pass filter 20, and applied to the current controlled oscillator 21 for processing and display in the same manner as previously described.

Points resistance readings are made by closing the ignition points 10 and then closing the ignition switch (FIG. 1). The resulting voltage across the closed ignition points is then used as an indication of proper points resistance. This voltage (V5) should be no larger than 0.25 volts for ignition points which are in acceptable physical condition. Comparator 19 has a threshold equal to 0.25 volts. Comparator 19 output is essentially open circuited for voltages less than 0.25 volts and closed with output current I3 when the comparator input exceeds 0.25 volts. The points resistance system operation is therefore one of zero display reading for acceptable points resistance and non zero display reading for excessive points resistance. Low pass filter 18 serves only to eliminate possible circuit crosstalk effects when the invention is operated in the tachometer or dwell mode.

Obviously many modifications and variations of the present invention are possible in light of the above teachings. It is therefore to be understood that within the scope of the appended claims the invention may be practiced otherwise than as specifically described.

The various functional blocks shown in FIG. 4 are composed of commercially available components. Low pass filter 12 and low pass filter 18 are both similar to the filter shown on page 104, FIG. 6-3 of the book *Theory and Problems of Feedback and Control Systems,* by Distefano III, Stubberud and Williams, published by McGraw Hill Book Company, 1967. Comparator 14 and comparator 19 are similar to the integrated circuit voltage comparator, part number LM339 made by National Semiconductor Corporation, Santa Clara, Calif. The monostable multivibrator 15 is similar to the multivibrator shown on page 113, FIG. 107 of the book, *RCA COS/MOS Integrated Circuits Manual,* by RCA Corporation, copyright 1971.

The switch S1 is a 3 position 2 pole switch similar to catalog number 1472 made by Centralab Electronics Division, Milwaukee, Wisconsin. Voltage to current converter 16 and voltage to current converter 17 are both similar to the converter shown on page 175, FIG. 6.3 of the book, *Circuit Design for Integrated Electronics,* by Hans R. Camenzind, published by Addison Wesley Publishing Company, Copyright 1968. Low pass filter 20 is similar to the filter shown on page Li-175, FIG. 6 of the *Harris Semiconductor Integrated Circuits Catalog,* July 1973. The current controlled oscillator 21 is similar to the oscillator shown on page 96, FIG. 2 of *Electronic Design Magazine,* Number 21, Oct. 11, 1975. Pulse generator 22 is similar to the generator shown on page 55, FIG. 2 of *EDN Magazine,* Mar. 5, 1973. The 4-digit counter with 7-segment outputs is an integrated circuit device made by National Semiconductor Corporation, part number MM74C925 and connected as shown on the Oct. 1975 data sheet for this device. The display 24 is composed of numeric LED display devices similar to part number FND367 made by Fairchild Camera and Instrument Corporation, Mountain View, Calif. The regulator is similar to monolithic three-terminal positive voltage regulator part number 7805UC made by Fairchild Camera and Instrument Corporation.

I claim:

1. A digital dwell tachometer with points resistance indication capability comprising:

means for producing a filtered ignition voltage waveform;

means for producing a first control signal whose average level is proportional to the engine dwell angle;

means for producing a second control signal whose average level is proportional to engine RPM (rotations per minute);

means for producing a third control signal whose value has the binary characteristic of being zero for acceptable ignition points resistance and positive for non acceptable points resistance;

mode select switch means for selecting the operating mode dwell, tachometer or points resistance indication;

means for producing a fourth control signal whose average frequency is proportional to the average level of either the first, second or third control signals depending upon the position of the mode select switch;

means for producing a fifth control signal having a pulse width interval inversely proportional to the number of engine cylinders;

cylinder select switch means for selecting the pulse width of the fifth control signal;

means of counting and converting into a digital display format the number of cycles of the fourth control signal which occur during the pulse width interval of the fifth control signal; and means of digitally displaying the number of cycles of the fourth control signal which occur during the pulse width interval of the fifth control signal.

2. The digital dwell tachometer with points resistance indication capability of claim 1 wherein the means for producing a first control signal comprises a voltage comparator.

3. The digital dwell tachometer with points resistance indication capability of claim 2 wherein the means for producing a second control signal comprises a monostable multivibrator.

4. The digital dwell tachometer with points resistance indication capability of claim 3 wherein the means for producing a third control signal comprises a voltage comparator.

5. The digital dwell tachometer with points resistance indication capability of claim 4 wherein the means for producing a fourth control signal comprises a low pass filter and a current controlled oscillator.

6. The digital dwell tachometer with points resistance indication capability of claim 5 wherein the means of counting and converting comprises a 4 digit counter with seven segment outputs.

* * * * *